US005685494A

United States Patent [19]

Kubach et al.

[11] Patent Number: 5,685,494

[45] Date of Patent: Nov. 11, 1997

[54] ELECTROMAGNETICALLY ACTUABLE FUEL INJECTION VALVE

[75] Inventors: Hans Kubach, Hemmingen; Guenter Dantes, Eberdingen; Karlheinz Schultheiss, Weinsberg, all of Germany

[73] Assignee: Robert Bosch GmbH, Stuttgart, Germany

[21] Appl. No.: 492,102

[22] PCT Filed: Nov. 18, 1994

[86] PCT No.: PCT/DE94/01359

§ 371 Date: Jul. 24, 1995

§ 102(e) Date: Jul. 24, 1995

[87] PCT Pub. No.: WO95/14858

PCT Pub. Date: Jun. 1, 1995

[30] Foreign Application Priority Data

Nov. 24, 1993 [DE] Germany ..... 43 40 016.7

[51] Int. Cl.[6] ..... F02M 51/00

[52] U.S. Cl. ..... 239/585.5; 239/102.1; 239/543

[58] Field of Search ..... 239/102.1, 504, 239/518, 519, 524, 543, 585.1, 585.3, 585.4, 596, 585.5, 452, 453

[56] References Cited

U.S. PATENT DOCUMENTS

| | | | |
|---|---|---|---|
| 4,666,087 | 5/1987 | Jaggle et al. | 239/585 X |
| 4,976,405 | 12/1990 | Graner et al. | 239/585 X |
| 5,323,966 | 6/1994 | Buchholz et al. | 239/585.4 X |

*Primary Examiner*—Andres Kashnikow
*Assistant Examiner*—Steven J. Ganey
*Attorney, Agent, or Firm*—Kenyon & Kenyon

[57] ABSTRACT

In an electromagnetically actuable fuel injection valve for fuel injection systems of internal combustion engines, including a of valve housing, magnetic coil and a valve closing element which, when the magnetic coil is excited, lifts off from a valve seat and releases fuel, to arrange in the outlet area of the fuel includes at least one diaphragm which is capable of oscillation and forms with other parts of the valve at least one (annular) metering gap and which can be excited solely by the pressure of the fed-in fuel to experience resonance oscillations so that a high-frequency modulation of the fuel lamella emitted from the (annular) metering gap, and a spray angle, is produced.

19 Claims, 6 Drawing Sheets

FIG. 1
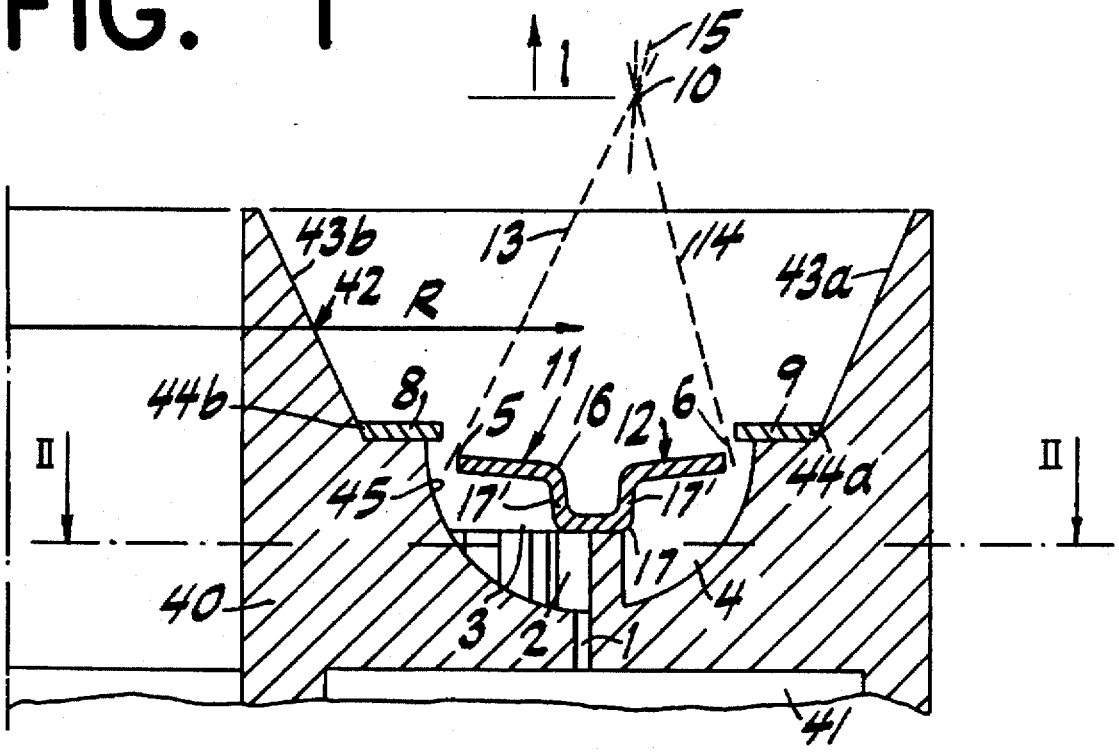
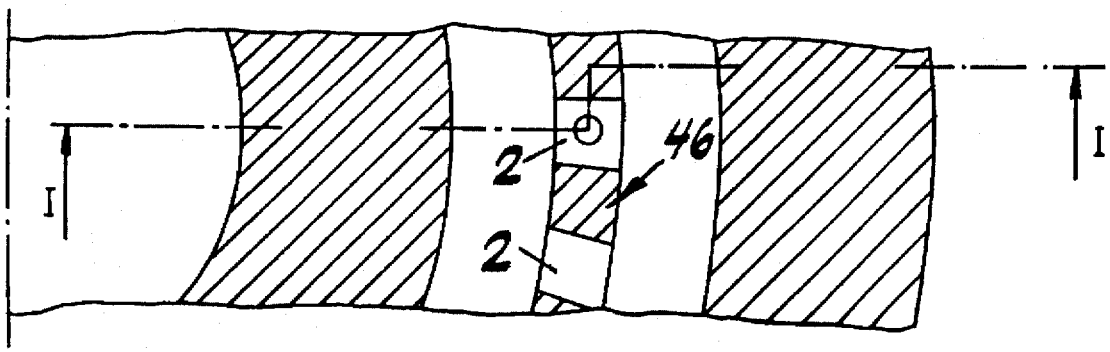
FIG. 2

$$Q_E + Q_M = -Q_A$$

$$A = -M$$

ELECTROMAGNETICALLY ACTUABLE FUEL INJECTION VALVE

FIELD OF THE INVENTION

The present invention relates to an electromagnetically actuable fuel injection valve.

BACKGROUND INFORMATION

Fuel injection values are known in a variety of embodiments and basic functions, for example as injection pin valves (German Patent Application No. 35 33 521) in which a magnetic coil which acts on an armature which is permanently connected to a valve needle is arranged in a valve housing made of ferromagnetic material. When the magnetic coil is excited, the valve needle is attracted and lifts off from the seat counter to spring pressure, the valve needle being supported in a guide hole of a nozzle element which is arranged on the valve housing. The valve needle projects here with a needle pin out of a central injection opening of the nozzle element, the conical valve seat face being formed between the guide hole of the nozzle element and the injection opening. With the exception of the area in the nozzle element from which the fuel emerges, fuel injection valves are always designed in this way or in a similar way—a valve closing element is always lifted off from its seat by the magnetic effect produced by the magnetic coil, the metered quantity of fuel being determined by varying the switch-on time with a constant drop in pressure and constant flow area. Another example of fuel injections valves are injection hole valves including so-called cap valves in which the fuel is often metered or example, by means of a prescribed number of fixed aperture plates, in the case of cap valves the aperture plate being spherically shaped in order to optimize the fuel inflow, inter alia, for the injection angle. In the case of aperture plates this is achieved instead by means of oblique holes (German Patent Application No. A 4026721.

In another example of fuel injection valves, swirl valves (European Application No. 0 057 407,) the fuel is given a swirl in the meeting hole so that it rushes up to form a conical lamella. In such swirl valves, structural problems which cannot be eliminated even by means of fine tuning arise from the fact that the diameter of the ejection edge is very small in comparison with the thickness of the lamella, i.e. excessively high emission turbulences occur which lead to a lamella length which fluctuates in a damaging way, and which are, if anything, reinforced by secondary swirls.

Finally, in another example of fuel injection valves, impact valves (U.S. Pat. No. 4,982,716), it is known to direct the emerging jet of fuel at an obstacle where it is reform e.g. into a turbulent conical lamella or into fan jets. It is also known to direct two jets against one another. In engines with internal combustion, the preparation of the fuel (petrol, but in particular methanol) during the injection to form very fine droplets with a selected direction of flight at a speed which is not too high is important. As a result, at all operating points a fuel/air mixture is produced which can be ignited well and burns as desired.

During the customary prepartion of the fuel which is emitted under a pressure of normally less than, for example, 5 bar without supplying extraneous energy, the preparation to form fine droplets usually takes place in that the fuel is emitted from the valve finely distributed in the form of lamellas or jets which have also been produced for example, by means of a swirl. The formation of droplets takes place as a result of the friction of this flow with a large ratio of v=surface/flow area, the increase in v only producing an asymptotic reduction in the droplet size of the fuel to scarcely less than 80 μm in average diameter. The production of turbulence in the finely distributed jet fuel before or after (jet impact) the valve outlet hardly reduces the diameter below the aforesaid value of 80 μm . Possibly converting the pressure energy into oscillations of approximately 2 kHz, as in the K-Jetronic from the applicant, does not give rise to significant success either in forming droplets with a diameter of less than 80 μm.

However, it is possibly to reduce the diameter of the droplets to typically 40 μm by using auxiliary energy, the following forms of auxiliary energy being conceivable.

Using air, the drop in pressure at the throttle valve >0.5 bar is sufficient during throttled operation of engines. However, the dethrottling of engines at highers levels of efficiency is opposed to the continuous application of this possibility.

Using externally excited oscillation systems, in particular using piezo resonators, the fuels is usually sprayed onto an oscillation disk or an edge from which it is released in fine droplets, during which process capillary waves can also be formed;

using electrostatic charging of the fuel and

Also using the heating of the fuel to just below the boiling point, during which process the sudden drop in pressure causes fuel components which have a low boiling point and are released during the expansion of the fuel in the valve to be degassed, as a result of which the fuel is dissipated to form fine droplets.

It is problematic that injection times <1 ms result in a high degree of nonlinearity and poor prepartion. Improvement in this respect is possible in valves in which the switching area and the metering area coincide, which therefore have the dead volume 0.

In intake manifold injection, metering generally takes place by changing, that is to say varying, the switch-on time of a fuel flow which is defined by a constant drop in pressure and a constant flow area. In this process, the switching area, that is to say the seat of the fuel valve, is located upstream, in the direction of flow, of a metering area which is normally provided downstream. The fuel in the intermediate "dead" volume is therefore necessarily at intake manifold pressure in the switch-off phase of the valve and can therefore easily evaporate in particular under the partial vacuum of the intake manifold and at a high temperature. It is therefore desired that:

the dead volume is small with respect to the smallest injection quantity; that the start of preparation occurs<0.8 ms after the opening of the valve; and that there is a good linearity up to injection times>0.8 ms.

If these requirements are fulfilled it is possible, in particular given injection into the open inlet valve and given multiple injections, to operate with very short injection times. As a result, the desired fuel/air ratio is achieved everywhere at low engine speeds even when there is a low degree of swirling of the mixture in the combustion space.

However, problems arise here because there is a collapse in pressure between the switching area and the metering area, that is to say in the dead volume when the valve opens, and because pressure fluctuations can occur after switching on in the area hydraulically upstream of the switching area.

These problems are due to the fact that a cross section $\pi DH$ becomes free during the travel H of a valve with a seat diameter D. On the other hand, the seat expels the volume $V=\pi/4\ D^2H$, $D>>H$. The result of this is that:

volume is absent between the seat which is still partially closed and the metering area so that a lower pressure with poor preparation occurs at the metering area; and because the flow does not increase continuously as the travel H increases but rather the filling up of the volume V during the change in the travel H is suddenly interrupted by the upper stop of the valve, which leads to hydraulic oscillations in the space in the direction of flow upstream of the seat. This means that nonlinearity is produced.

The present invention is correspondingly based on the object of achieving extremely fine droplets at a low speed, a high degree of efficiency of the conversion of the pressure energy present in the fuel into the surface energy, inversely proportional to the diameter, of the fuel emerging from the valve being produced. As a result, further energy carriers, for example compressed air, can be dispensed with, the intention being that attachment to existing electromagnetically actuable injection valves should also be possible.

SUMMARY OF THE PRESENT INVENTION

The invention achieves this object and has the advantage that a particularly good degree of efficiency in the conversion of the pressure energy of the fuel (for example 3 bar) to the surface energy which is inversely proportional to the diameter is obtained. In this process, various energy carriers which are occasionally used for forming extremely fine droplets can be dispensed with so that their costs, unreliability and installation problems are also obviated.

In contrast with the above, the present invention uses, instead of this extraneous auxiliary energy, the pressure energy, available in any case virtually in the same order of magnitude, of the supplied fuel, which pressure energy is required in any case for example, to prevent vapor bubbles of a prescribed size.

The present invention thus permits a large surface of the fuel during emission, the rapid spatial distribution of the fuel in order to prevent droplet recombination and desired turbulence in the fuel, even before it enters the air, by virtue of a high-frequency (>20 kHz) change in the spraying direction of the fuel.

Here, it is essential that the oscillatory behavior, made possible by the present invention, of emerging fuel lamellas should lie in a high-frequency range by orders of magnitude (namely >20 kHz) above the oscillatory behavior of injection valve components which can be tuned for example to 2 kHz, which is the case in a known manner, for example, in the R-Jetronic, to name a concrete example here. Therefore there are no connections with the present invention.

The present invention succeeds, by utilizing a spring-elastic behavior of valve components which are intentionally provided in this way, in providing in the area of the metering area a spring-elastic, theoretically loss-free system which with a selective oscilliation regeneration produces, in comparison with excitation, high levels of oscillation energy of the fuel emerging in lamella form, a theoretical conversion of energy taking place as the lamellas draw apart and the lateral speed being in principle completely converted into surface energy in a corresponding way. Therefore there is an effective atomization at the smallest possible droplet size with a small dead volume, a good degree of preparation at the start of the opening of the valve, in particular with full pressure during the opening process, and a good degree of linearity.

It is particularly advantageous to construct the spring/mass system of the oscillatory arrangement such that its "spring" is formed by means of two diaphragms which can alternately receive the volume of the oscillating fuel. Thus, the compressibilty of the fuel can be dispensed with, in contrast with the Helmholtz resonator, and the volume of fuel can be kept small. The masses of the oscillatory system are composed of the diaphragm masses and the fluid masses.

BRIEF DESCRIPTION OF THE DRAWINGS

FIG. 1 shows a portion of a metering gap area of an electromagnetically actuable fuel valve according to the present invention along the lines I—I shown in FIG. 2.

FIG. 2 shows a partial view of a section of the metering gap area according to the present invention along the line II—II shown in FIG. 1.

DETAILED DESCRIPTION OF THE INVENTION

Figure 3:
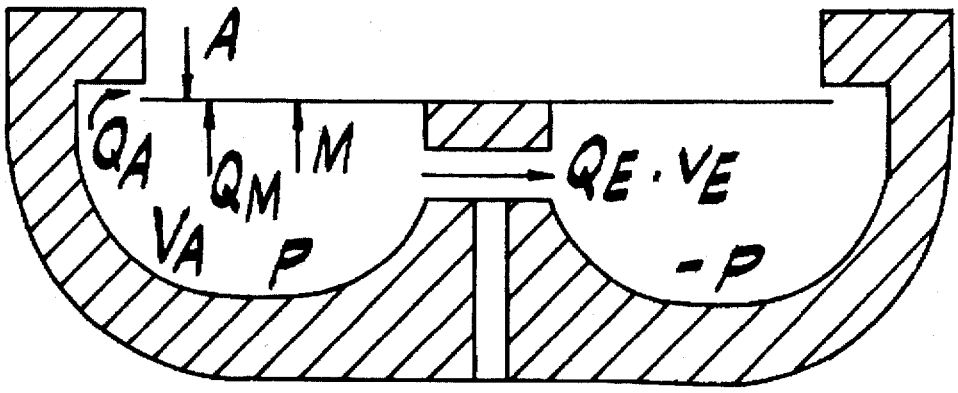
FIG. 3 shows a developed view of the functional component shown in FIG. 1 with diaphragm plates according to the present invention outlined in schematic form.

The basic idea of the electromagnetically actuable fuel injection valve according to present invention consists, for the purpose of forming a metering gap area which is located downstream of the valve seat of an electromagnetically actuable injection valve, in providing at least one, preferably two, formations, structures, diaphragms or plates which are capable of oscillation and have an opposing oscillation behavior (in phase—antiphase), and in modulating an emerging jet fuel or a fuel lamella in the widest sense, according to the spray angle, emission behavior, amplitude of oscillation, pulse.

The images illustrated in the following figures each represent only the fuel emission area, more precisely of the area of an (annular) metering gap, and are arranged downstream of the valve seat of a fuel injection valve which can be actuated electromagnetically and is known per se. Such fuel injection valves are is described, for example in the publication mentioned above which corresponds to German Patent Application No. 35 33 521 and relates to injection pin valves, in which case of course, the injection pin area is dispensed with and is replaced by the embodiments according to the present invention which are described below and which may also be understood to be possible supplementary attachments to existing injection valves.

The embodiments according to the present invention includes described below usually annular emission areas of electromagnetically actuable fuel injection valves and can also be understood as such; however the present invention, of course, also includes non-circumferential systems which terminate for example at side walls (radius R=∞).

FIGS. 1 and 2 show a (circumferential) annular structure 40 which is arranged at the bottom of the fuel injection valve and is adjacent at the bottom to a pressure space 41 in the drawing plane of FIG. 1 and in this way forms on the outside at the top a recess 42 which runs round in a groove shape and, starting from side faces 43*a*,43*b* which lie opposite one another and taper in a conical shape, merges, forming shoulders 44*a*,44*b* on both sides. A uniformly curved groove 45 of for example semicircular shape is thereby formed and is divided by means of an approximately centrally arranged intermediate web 46 which is interrupted at intervals over its circumference by openings or recesses. These recesses in the central intermediate web 46 are connected to a pressure space 41 via at least one inner channel or one pipe 1, and since the openings in the intermediate web 46 are open on both sides, altogether oscillation spaces 3, 2 and 4 are formed as is shown by FIG. 1. The oscillation spaces 3 and 4 are connected to diaphragms or plates 11, 12 which are capable of oscillation and can also be manufactured from a piece of shaped sheet-metal material (illustrated in section in FIG. 1) by means of a punching or drawing process. The diaphragms 11 and 12 are constructed to run flat against the horizontal at their edges where they form annular emission gaps 5, 6 with elements lying opposite, on which details will be given below. And the diaphragms 11 and 12 can be slightly bent upward in the end area. On the inside they merge with cylindrical diaphragm sections 17' forming curved portions 16 which serve as reinforcements, and they span, with a thin intermediate diaphragm element 17, the aforesaid recesses or slits as oscillation space 2 in the central web 46 which supports them.

Such an arrangement, including of the compressible spaces 3 and 4 (the compressibility is provided here by the spring elasticity of the diaphragms 11 and 12) and the moved masses of the fuel in the slits 2 and the emission gaps 5 and 6 (the moved mass in the oscillation spaces 3 and 4 is negligible because the speed is very low there), forms an acoustic sound space, in which case when resonance occurs the fuel flows backward and forward through the central slits 2 between the oscillation spaces 3 and 4.

The schematic developed view in FIG. 3 is referred to—the expulsion $Q_M$ of fuel plus the outflow $Q_A$ and the alternating flow at the gaps $-Q_E$ correspond to one another. The inflow opening 1 is located in the pressure-neutral area and is additionally relatively long so that the oscillation energy W~ cannot enter the pressure space 41.

Figure 4:
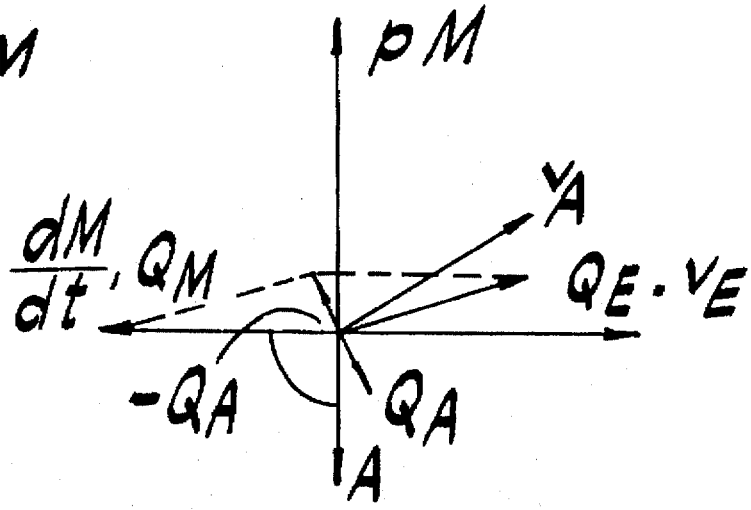
FIG. 4 shows, as a vector diagram, relationships between fuel flow rates in the case of resonance according to the present invention.

The drop in pressure at the emission openings then has an energy-damping-compensating effect for the oscillations if the outflowing oscillation energy W~ is negative. $W \sim \upsilon_A.V.A$ (V=constant component of the speed). For the angle $\upsilon_A$, A must therefore equal $90° > \epsilon_A$, $A < 270°$. $\upsilon_A$, A=180° is the most effective. The outflow energy of the oscillating system is therefore lower in both half periods than that of the static system. The difference in energy covers the oscillation losses. The vector diagram in FIG. 4 shows the phase position of the alternating variables in FIG. 3. Pressure p is in phase with the diaphragm position M as long as the natural resonance of the diaphragm is not exceeded (above resonance p is in antiphase). The flow $Q_M \sim dM/dt$ is in advance of M by $90° \cdot QE \sim \upsilon_E$ follows the pressure p by 90° with no losses because of the determining mass: when losses occur the angle is somewhat smaller.

The opening surface A is opposed to M by 180°. When the jet is not very tall (and its mass has little determining effect), the outflow speed $\upsilon_A$ follows p with somewhat less delay than $\upsilon_E$, so that $\upsilon_A$, $A > 90°$ is ensured. $Q_A = -Q_E - Q_M$ lies within $\upsilon_A$, A, as desired.

With suitable configuration, the fuel oscillates between 3 and 4 in FIG. 1. Correspondingly, the surfaces A of the slits or annular emission gaps 5 and 6 open alternately.

Therefore, fuel emerges from the pressure space 41 through the pipe(s) 1 into the oscillation spaces 2, 3 and 4 and passes through the annular metering gap openings 5 and 6 as fine lamellas 13 and 14 into the ejection space. The end areas of the diaphragms 11 and 12, which are for example attached to the shoulders 44*a*, 44*b*, are bounded by the baffle elements 8 and 9 each including a respective directing surface extension the extensions arranged in such a way that the emerged fuel lamellas are emitted forward directed toward one another at a suitable angle. By virtue of the different design of the radial and axial metering gaps between the baffle element and diaphragm (in particular as a result of the angle between the gaps through which the flow passes), the deflection of the outer fuel lamellas 14 is greater so that at the collision of the lamellas in the impact area 10 the lamellas are propelled in a direction pointing toward the outside, that is to say away viewed from the imaginary center point of the annular shape and leading to the right in the drawing plane in FIG. 1 remains. After the impact at the impact point 10, the fuel is reflected symmetrically with respect to the flow-in axis at an exit angle smaller than the angle of incidence, and finely atomized.

If the two diaphragms oscillate in antiphase, the two lamellas are each turned inward or outward in the same direction so that the impact area 10 is pivoted inward or outward. The pulse of the two lamellas also varies at $\upsilon_A$. A. Similarly to FIG. 5 for an individual lamella, the center point of the jet also varies after the pulse set downstream of the impact area 10 as a function of the wavelength (λ=fuel speed/oscillation frequency) and of the distance from the two ejection points 5 and 6. When the impact angle of the two lamellas 13, 14 is greater, the lamellas break up into droplets even in the impact area 10, when the angle is smaller a resulting lamella is produced.

As already mentioned, the diaphragms 11 and 12 run flat against the horizontal at their edges and thus in a rotationally symmetrical (with radius R, FIG. 1) or circumferential system permit a larger radial travel H than the expansion $\epsilon_{max}$ ($\epsilon_{max} = \sigma_{max}/E$; $\sigma_{max}$=tensile strength, E=modulus of elasticity).

For cylindrical diaphragms, $H_{max} = \epsilon_{max}$. R. The stiffening by the cylindrical diaphragm sections 17' in the junction with the curved portions 16 is used to span the slits 2 in a stable way with the thinner central diaphragm section 17.

The pressure in the oscillation spaces 3 and 4 is applied in planar diaphragms by means of flexural stresses σ (they are then physically plates). In proportion to the angle of inclination of the diaphragm with respect to the plane in the direction of overpressure, radial and tangential tensile stresses arise as a result of the pressure in the diaphragms, which tensile stresses define the position of the diaphragm and the natural frequency, even without flexural strength (physically diaphragms do not have any flexural strength). This natural frequency of the diaphragms is, in contrast with the plates, pressure-dependent. This can be used to adjust the natural frequencies of the diaphragm and of the hydraulic spring/mass system when the pressure is incorrectly high, in such a way that the amplitude of oscillation is reduced in order to protect the diaphragm against overstressing. Diaphragm plates which are superimposed on the tensile stress and flexural stress of approximately the same size are particularly favorable and are illustrated in FIG. 1.

Figure 6:
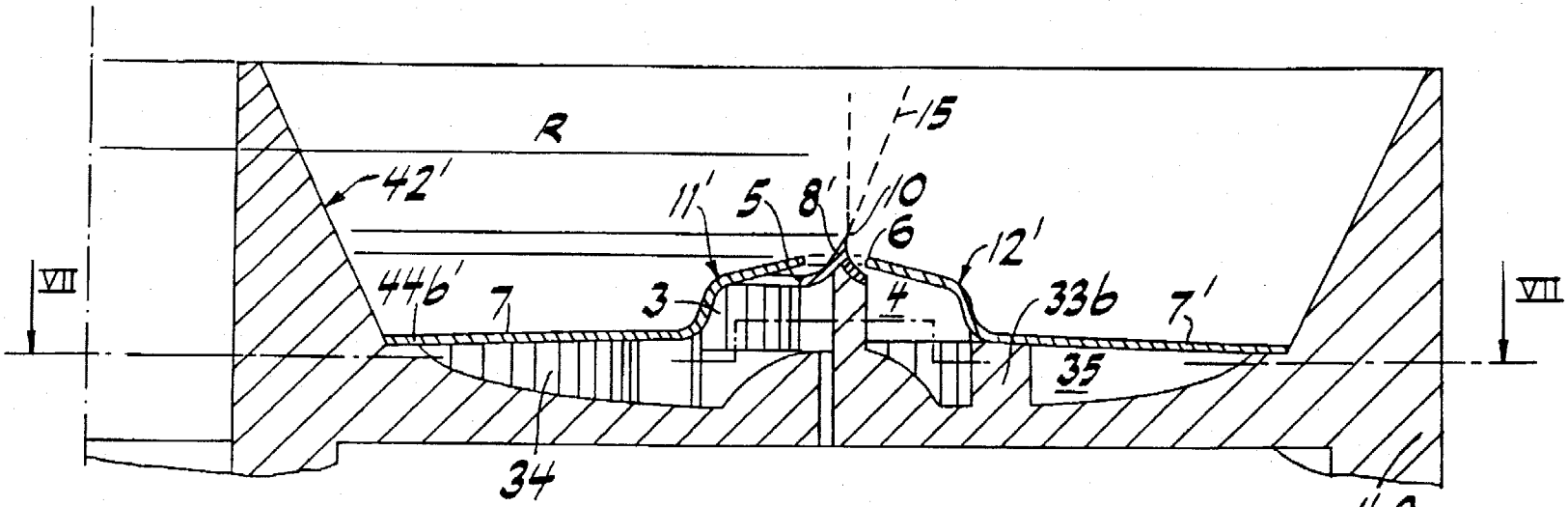
FIG. 6 shows another embodiment of the present invention as a partial view along the line VI—VI shown in FIG. 7.
Figure 7:
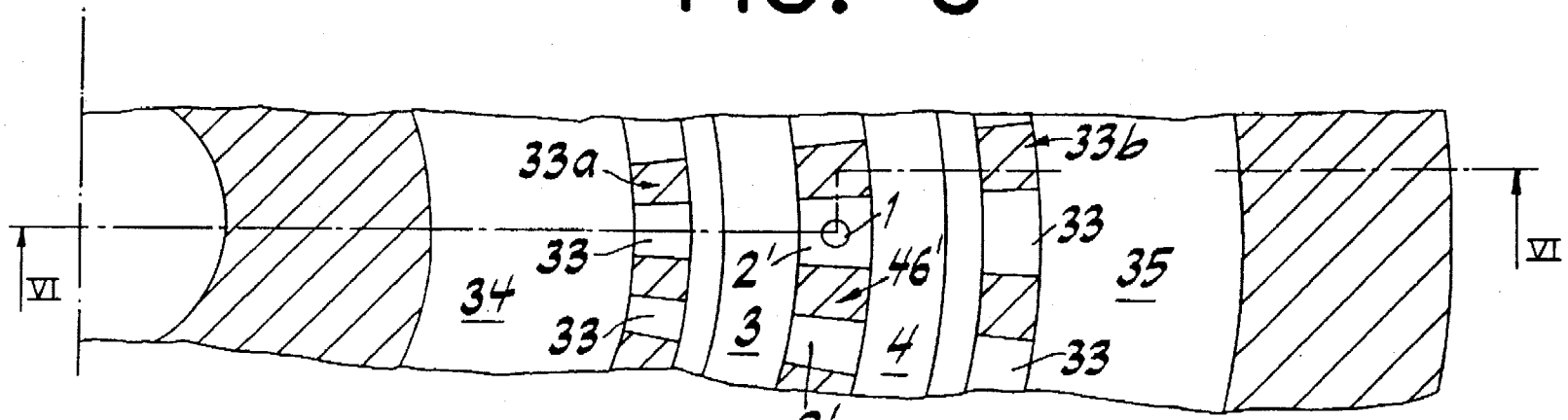
FIG. 7 shows a top view along the line VII—VII shown in FIG. 6.

A further embodiment according to the present invention is shown in FIGS. 6 and 7. In this embodiment, the diaphragms 11' and 12' which are capable of oscillation are arranged on the outside. In order to be able to determine the respective natural frequencies better, a total of four, if the slits in the remaining central web 46' are also considered as oscillation space, a total of five, pressure spaces or oscillation spaces are provided, the entire recess being broader and being covered by spring elements 7, 7', extending on both sides as far as the shoulders 44*a*', 44*b*' (being integral), of the diaphragms 11', 12'. Therefore, two further intermediate webs 33*a*, 33*b* are added, likewise assuming a circumferential system, which run around in a circular shape, with corresponding openings or slits 33 in both intermediate webs 33*a*, 33*b* which permit passage through them and thus permit the oscillation behavior of the supplied fuel. In this case, the diaphragms 11' and 12' are attached with their preferably integral lateral extensions in the form of spring elements, or also diaphragms 7, 7', by means of the intermediate webs 33*a*, 33*b* in such a way that fuel is connected from the oscillation spaces 3 and 4 to oscillation spaces 34, 35 lying further outward. The central web 46' forms a common baffle element 8', which tapers in the spray direction in a conical shape. The conical tip of the common central baffle element 8' may be further extended in the spray direction beyond the area that forms annular emission gaps 5 and 6.

The diaphragms 11', 12' open under static pressure. For reasons of energy, they must however close under pressure at operating frequency in order to achieve self-excitation, i.e. they must be operated above the natural resonance at 180° phase shift of the diaphragm position with respect to pressure, i.e. the diaphragm has the oscillation characteristic of a mass. The fuel in the coupling area of the coupling slits 2' also has mass characteristic in respect of the pressure in the oscillation spaces 3 and 4. The spring elements 7, 7' are of separate construction in order to receive the volume flows of the diaphragms and of the coupling area.

Figure 8:
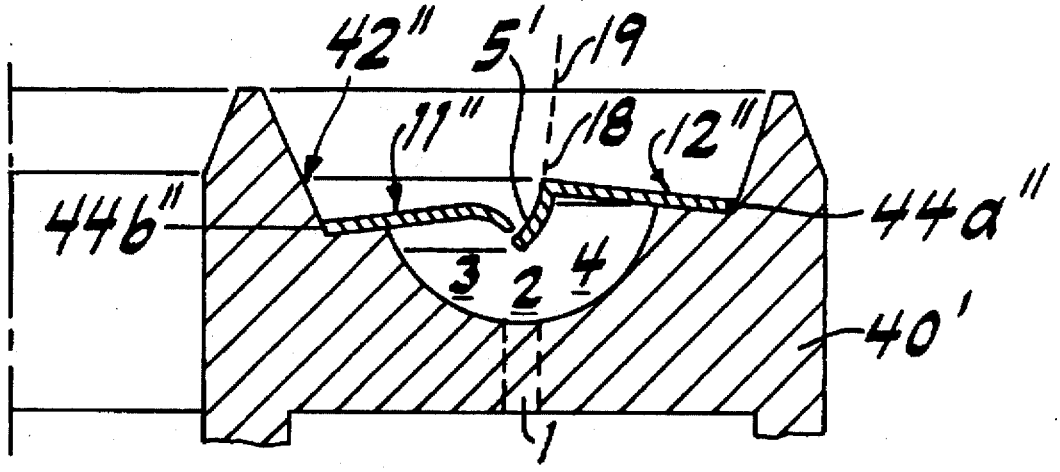
FIG. 8 shows a sectional view of an alternative embodiment for the metering gaps according to the present invention using diaphragms which are capable of oscillation.

The lowest natural frequency is that as shown in FIG. 8, the oscillating diaphragm 11 initially extending outward at a very obtuse angle and subsequently being bent downward in the direction of the opposite diaphragm 12" while the opposite diaphragm 12" also rises outward at an obtuse angle and subsequently extends bent inward in a concavely recessed way such that its end area is directed to and aligned with the front edge of the oscillation diaphragm 11" forming a narrow (annular) emission metering gap for the fuel.

The system according to the present invention operates such that when the pressure oscillation in the oscillation spaces 2, 3 and 4 has a positive instantaneous value the diaphragm 12" closes the metering gap 5' (statically and dynamically in phase), the diaphragm 11" additionally closing the metering gap 5' counter to the pressure (statically and dynamically in antiphase: frequency lies above the natural resonance, mass characteristic). Thus, the energy requirement for self-excitation is fulfilled—oscillation of the opening A (FIG. 4) and speed oscillation are in antiphase. The volume of fuel in phase with respect to the pressure is then, at the moment of maximum pressure in the pressure space 2, rather in the right-hand chamber half which is of course common in this case, therefore in the area of the pressure space 4, spring energy being stored in the diaphragms 11" and 12" and the movement energy=O. In the next quarter period of the oscillation, the spring energies are converted into movement energy of the fuel and of the diaphragms, specifically in such a way that the movement energy of the fuel in the pressure spaces or chamber sub-areas 2, 3 and 4 rather comes from the spring energy of the diaphragm 12" while the movement energy of the diaphragm 11" mainly originates from the diaphragm's own spring energy. Then, the pressure in the pressure space 2 (and therefore also, for example, the emission speed $\upsilon_A$) has the phase position desired at the metering gap 5' ($P_{min} \approx \upsilon_{Amin}$; valve open). This also applies when theoretically only a resulting spring force (after deduction of the force for diaphragm acceleration) occurs at the diaphragm 12" and a resulting mass occurs at the diaphragm 11", to which the mass of the fuel in the chamber sub-spaces or oscillation spaces 2, 3 and 4 may then possibly be added.

Since all the diaphragms with a suitable small radius R in the bending area may not significantly leave the horizontal position, the movement of the oscillating diaphragm takes place in a direction perpendicular thereto. If the opening direction of the annular metering gap 5 with respect to the horizontal is 45°, only the root second part of the travel is converted into opening. Since the opening angle of a spray cone generally has to be smaller than 90°, the deflection of the sprayed lamella 19 is required, for example such as shown in FIG. 8. Thus, the angle at which the lamella leaves the diaphragm 12" in the acute, virtually right-angled bending area 18 from the horizontal progression of the lamella 19 is increased to give the inwardly directed concave shape. The angular modulation of the lamella according to FIG. 8 can be lower in comparison with the embodiments according to the present invention explained above.

Figure 5:
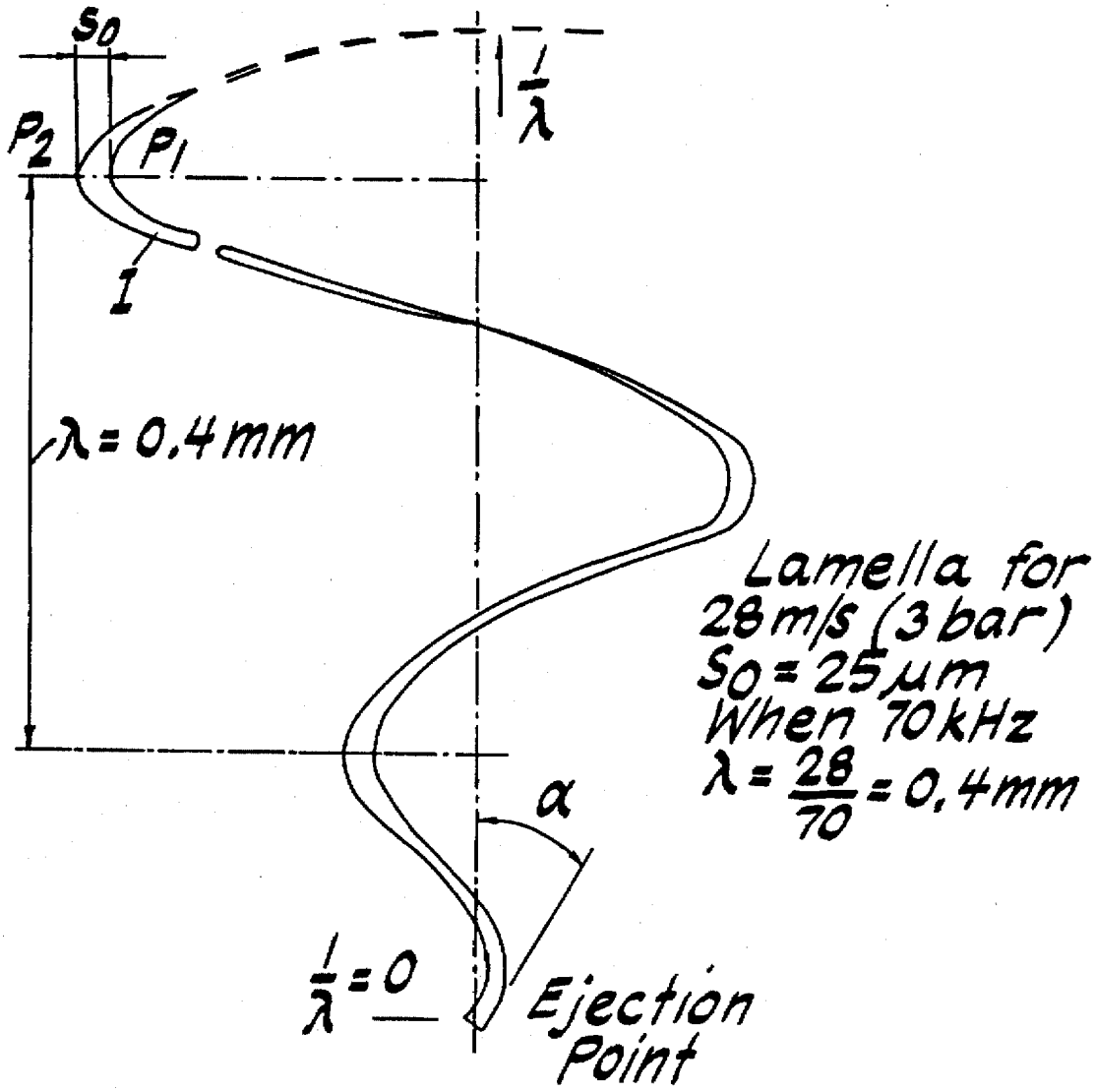
FIG. 5 shows the oscillatory behavior of fuel lamellas emerging from the metering gap areas according to the present invention.
Figure 9:
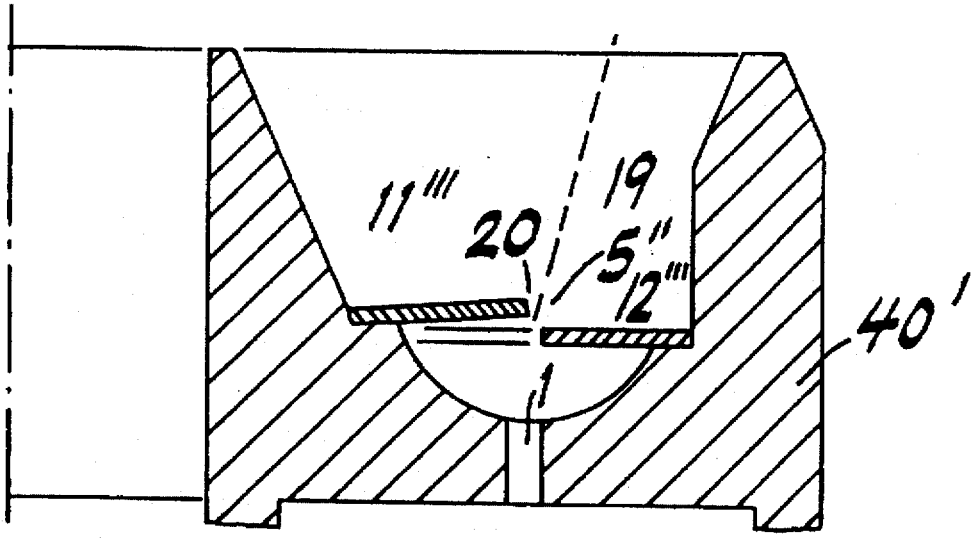
FIG. 9 shows a sectional view of another alternative embodiment for the metering gaps according to the present invention using diaphragms which are capable of oscillation.

The illustration in FIG. 9 corresponds in its design approximately to the embodiment in FIG. 8 with the same basic shape of the bearing annular element 40', the diaphragms 11"' and 12"', which extend outward at an obtuse angle with respect to the horizontal having, in the area of the annular metering gap which is formed by their ends themselves, such axial and radial spacings that the emission lamella 19 of the fuel has the angle indicated in FIG. 9. If the diaphragms oscillate, an angular modulation according to the diagram in FIG. 5 is produced.

Figure 10:
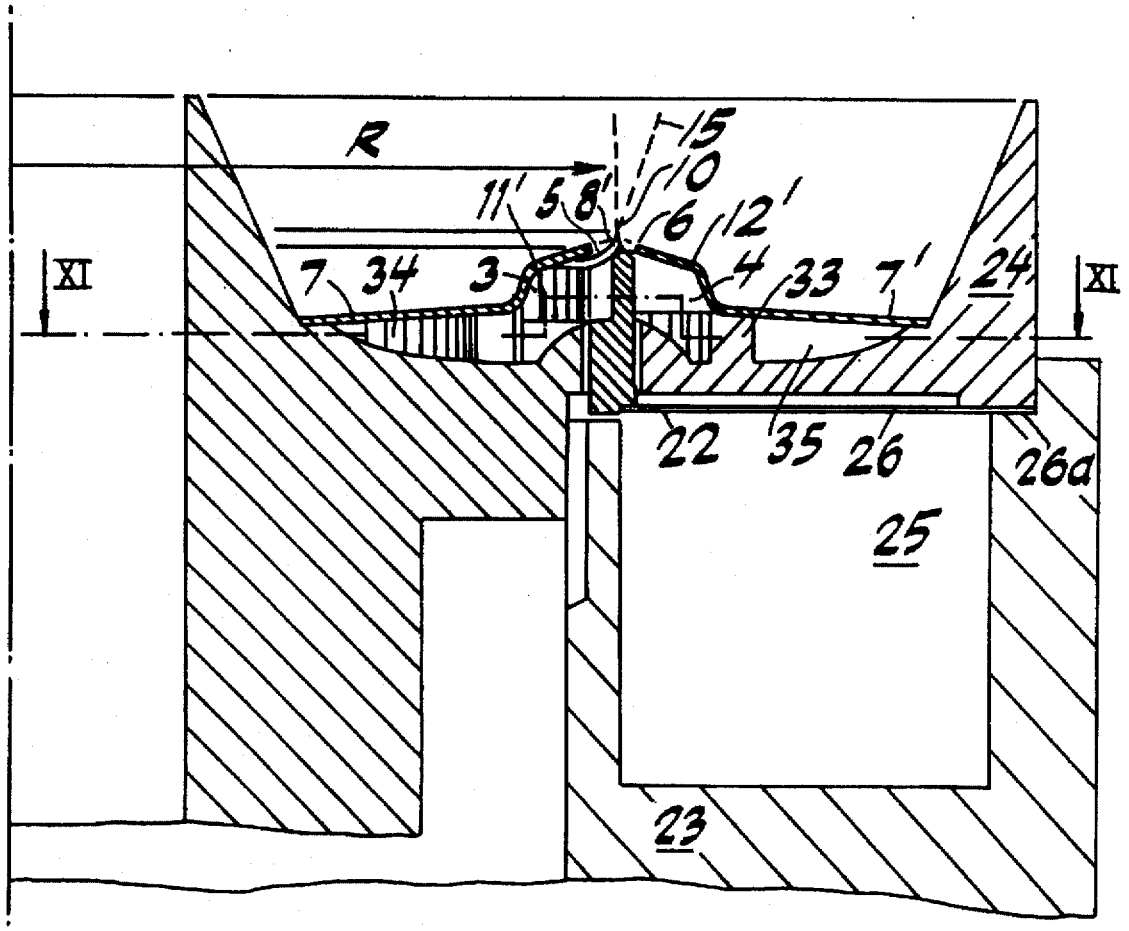
FIG. 10 shows a sectional view of a detail of another embodiment according to the present invention.
Figure 11:
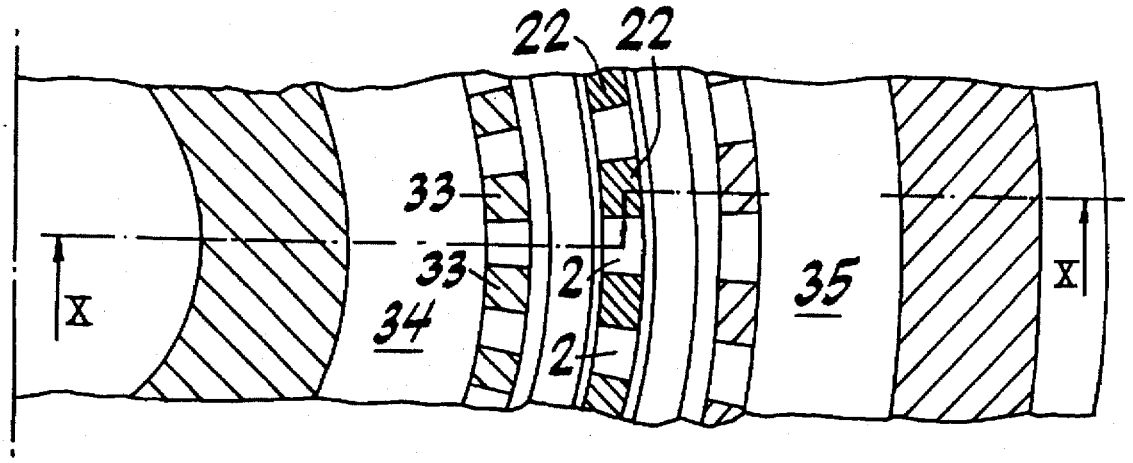
FIG. 11 shows a sectional view of a detail of yet another embodiment according to the present invention.

Finally, FIGS. 10 and 11 show an embodiment according to the present invention corresponding approximately to the illustration in FIGS. 6 and 7 so that the two reference symbols are also retained.

The difference is that the central baffle element 8"—of essentially the same shape as in the FIGS. 6 and 7—simultaneously forms the closing element of the electromagnetically actuable injection valve—in other words the valve seat is formed by the inner edge faces of the oscillation diaphragm 11', 12'. The intermediate component which simultaneously forms the baffle element in the valve element is preferably immediately constructed integrally as part of the armature 22 of the magnetic circuit which is assigned to the magnetic coil 25. The magnetic circuit is completed by means of baffle elements 23, 24, the armature/baffle elements 22, 8" being radially and axially guided by a spring-elastic part or even annular part 26 which is clamped in at 26a and is thus constructed in such a way that in the deenergized state of the coil 25 the armature 22 with baffle element 8" is pressed against the diaphragm 11', 12', as a result of which the system is closed. The fuel chambers or oscillation spaces 3, 4 are connected to one another via the corresponding feed lines or lateral openings 2' (already mentioned above), now in the armature 22 which is also constructed in a circular ring shape, so that the diaphragms 11', 12' can oscillate (as usual) in push-pull fashion. Mere, the spring-elastic areas (chambers or oscillation spaces 34, 35) formed by the diaphragms 7, 7' can be formed both by the diaphragms 7, 7' and by large fuel volumes with compressibility according to Helsholtz since the volume of fuel no longer acts as a dead volume (therefore may be as large as desired) because the area in front of the gaps or (annular) metering gaps 5, 6 is always under excess pressure that escape of vapor and a drop in pressure during opening are prevented. The oscillation of the diaphragms 11', 12' therefore begins actually during the opening travel. Given an assumed oscillation frequency of the diaphragm 11', 12' of approximately 50 kHz, a large number of periods are also available during the opening travel for excitation.

Of course, the variants and possibilities disclosed in the various embodiments according to the present invention can also be combined with one another as desired, the disclosed restriction on the vertical positioning of the diaphragm plane from the horizontal with practical values of the radius R (FIG. 1) not applying if the systems are not circumferential but rather end, for example, at side walls. Then, $R=\infty$ is possible. However, the area at the walls does not also oscillate.

In summary, the present invention permits the desired fine preparation with extremely fine droplet formation with a limited droplet emission speed, the deflection, disclosed specifically in the embodiments according to the present invention shown in FIGS. 1 and 6, of the fuel lamella operating with, in terms of energy, a highly effective constancy of the pulses on impacting. The pulses are modulated favorably in terms of energy in that the spring elasticity of the diaphragms produces, inter alia with the fuel mass, a spring-elastic, theoretically loss-free system. Only such loss-free or low-loss systems with selective regeneration of oscillation can produce high levels of oscillation energy in comparison with the excitation. Here, the theoretical conversion of energy does not take place until the lamella is drawn out according to FIG. 5, the lateral speed being correspondingly converted into surface energy. The lateral speed can here be in theory completely converted into surface energy, the angle $\alpha_{max}$ no longer increasing then. This case cannot be achieved in air because the air resistance of a lamella of fluid flying, according to the features of the present invention, with its broad side against the air is greater than the resistance of a conventional lamella flying with the narrow side against the air (this resistance is conventionally responsible for the breaking up of the droplets) at least by the length of the broad side, divided by the thickness of the lamella. Thus, the lamella is broken up into fine droplets by the main component of the emission speed before the smaller surface tension can draw the lamella together to form large droplets. According to the function diagram in FIG. 5 this is particularly effective in the area $|\alpha|<|\alpha_{max}|$. In the area $\alpha\approx\alpha_{max}$ the relative speed of the fuel/air is greater than usual because the air is not carried along by the lamella which conventionally flies ahead. The end face with large ram pressure is greater than is conventionally the case where only the friction forces operate. Thus, even at $\alpha\approx\alpha_{max}$ good atomization takes place. Finally, the fuel is thus braked particularly effectively to the extent that it can be carried along by the air flowing past before it reaches the wall where the desired preparation then no longer has any benefit.

Such dynamic requirements such as small dead volumes, good preparation at the start of the opening of the valve, in particular by full pressure during the opening process, and good linearity can be realized well by means of outwardly opening valves, which valves may meet with certain reservations however because they can open under overpressure of the fuel and if the closing element breaks off, could experience a large throughflow which would be dangerous in technical safety terms.

This is different with the exemplary embodiment according to the present invention in FIGS. 9 and 10, which also fulfills the dynamic requirements mentioned above to an optimum degree since the dead volume=O because the seat and (annular) metering gap coincide so that good preparation is also immediately possible at the start of the opening of the valve with correspondingly good linearity. In addition to this, with the embodiment according to the present invention in FIGS. 10 and 11 there are also the advantages that the excitation of oscillations in the feed areas is significantly lower since there the expelled fuel volume is $H.\pi/4.(D_2^2-D_1^2)$ with the same cross section and valve travel H; however with a conventional, outwardly opening valve of the same flow area this expelled fuel volume is $H.\pi/4.\ (D_1+D_2)^2$. Thus, the volume with the embodiment according to the present invention in FIG. 10 is virtually at least five times smaller than with a conventional valve.

What is claimed is:

1. An electromagnetically actuable fuel injection valve for a fuel injection system of an internal combustion engine, comprising:

a valve housing;

a magnetic coil at least partially surrounding the valve housing;

a valve closing element cooperating with the valve housing and being responsive to the magnetic coil, the valve closing element lifting off from a valve seat when the magnetic coil is excited and releasing fuel into an outlet area; and at least one diaphragm disposed downstream of the valve seat and having an outer periphery defining at least one metering gap, the at least one diaphragm oscillating in the outlet area in response to a pressure of the fuel released into the outlet area.

2. The electromagnetically actuable fuel injection valve according to claim 1, wherein the at least one metering gap in annular.

3. The electromagnetically actuable fuel injection valve according to claim 1, wherein the at least one diaphragm includes a first diaphragm having a first outer periphery and a second diaphragm having a second outer periphery and the at least one metering gap includes a first metering gap and a second metering gap, the fuel injection valve further comprising:

a first baffle element disposed opposite the first outer periphery to form the first metering gap; and a second baffle element disposed opposite the second outer periphery to form the second metering gap, the fuel being emitted from the first and second metering gaps in a lamella form.

4. The electromagnetically actuable fuel injection valve according to claim 3, wherein the first and second metering gaps are annular.

5. The electromagnetically actuable fuel injection valve according to claim 1, wherein the at least one diaphragm includes a first diaphragm and a second diaphragm, the first diaphragm extending towards the second diaphragm, the at least one metering gap being formed between the first and second diaphragms.

6. The electromagnetically actuable fuel injection valve according to claim 1, wherein the at least one diaphragm includes a first diaphragm, a second diaphragm, a third spring-elastic diaphragm and a fourth spring-elastic diaphragm, the fuel injection valve further comprising:

an annular element adjoining the valve seat and being coupled to the valve seat via an inflow channel, wherein an inner portion of the annular element forms a recess, the recess having at least one side wall that tapers upstream counter to a direction of a flow of fuel, the first diaphragm and the recess defining a first oscillation space, the second diaphragm and the recess defining a second oscillation space, the third diaphragm and the recess defining a fourth oscillation space, the fourth diaphragm and the recess defining a fifth oscillation space, the fourth oscillation space being outwardly adjacent to the first oscillation space and the fifth oscillation space being outwardly adjacent to the second oscillation space;

a first intermediate web separating the fourth oscillation space from the first oscillation space;

a second intermediate web separating the fifth oscillation space from the second oscillation space; and wherein the first diaphragm extends toward the second diaphragm, the first and second diaphragms terminating adjacent to a central baffle element connected to a central web, the baffle element tapering in a conical shape in a direction of a spray of the fuel from the first and second metering gaps.

7. The electromagnetically actuable fuel injection valve according to claim 6, wherein the third diaphragm is formed integrally with the first diaphragm and the fourth diaphragm is formed integrally with the second diaphragm.

8. The electromagnetically actuable fuel injection valve according to claim 7, wherein the first and second diaphragms formed integrally with the third and fourth diaphragms are supported via at least one shoulder portion of the annular element and wherein the baffle element includes a conical tip, the conical tip extending in the spray direction beyond an area defined by the first and second metering gaps to determine an angular position of the emitted fuel lamella.

9. The electromagnetically actuable fuel injection valve according to claim 6, wherein the valve closing element includes the central baffle element, an armature of the magnetic coil being connected to the central baffle element.

10. An electromagnetically actuable fuel injection valve for a fuel injection system of an internal combustion engine, comprising:

a valve housing;

a magnetic coil at least partially surrounding the valve housing;

a valve closing element cooperating with the valve housing and being responsive to the magnetic coil, the valve closing element lifting off from a valve seat when the magnetic coil is excited and releasing fuel into an outlet area;

at least one diaphragm disposed downstream of the valve seat and having an outer periphery defining at least one metering gap, the at least one diaphragm oscillating in the outlet area in response to a pressure of the fuel released into the outlet area and including a first diaphragm and a second diaphragm, the at least one metering gap including a first metering gap and a second metering gap; and an annular element adjoining the valve seat and being coupled to the valve seat via an inflow channel, wherein an inner portion of the annular element forms a recess, the recess having at least one side wall that tapers upstream counter to a direction of a flow of fuel, the first diaphragm and the recess defining a first oscillation space, the second diaphragm and the recess defining a second oscillation space, the first diaphragm partially converting the first oscillation space and defining the first meeting gap, the second diaphragm partially covering the second oscillation space and defining the second metering gap, and wherein an alternating flow of fuel is emitted via the first and second metering gaps when the valve is opened with a high frequency, the high frequency being determined as a function of the first and second diaphragms.

11. The electromagnetically actuable fuel injection valve according to claim 10, wherein the alternating flow of fuel includes a flow of fuel our of each of the first and second metering gaps as a fuel lamella having a high pulse portion and a low pulse portion, the fuel lamellas emerging from the first and second metering gaps forming an impact area at a predetermined distance from the first and second metering gaps.

12. The electromagnetically actuable fuel injection valve according to claim 10, wherein the first and second oscillation spaces are separated by a central web, the central web having at least one opening forming a third oscillation space, the at least one opening connecting the first and second oscillation spaces.

13. The electromagnetically actuable fuel injection valve according to claim 12, further comprising:

an integral oscillation system supported by the central web, the integral oscillation system having a first wing extending substantially horizontally outward to form the first diaphragm having a first outer edge portion and a second wing extending substantially horizontally outward to form the second diaphragm having a second outer edge portion;

a first baffle element disposed opposite the first outer edge portion to form the first metering gap, the first baffle element supported by a first shoulder portion of the annular element and including a first directing surface extension for determining an angle of a fuel lamella emitted via the first metering gap; and a second baffle element dispose opposite the second outer edge portion to form a second metering gap, the second baffle element supported by a second shoulder portion of the annular element and including a second directing surface extension for determining an angle of a fuel lamella emitted via the second metering gap.

14. An electromagnetically actuable fuel injection valve for a fuel injection system of an internal combustion engine, comprising:

a valve housing;

a magnetic coil at least partially surrounding the valve housing;

a valve closing element cooperating with the valve housing and being responsive to the magnetic coil, the valve closing element lifting off from a valve seat when the magnetic coil is excited and releasing fuel into an outlet area;

at least one diaphragm disposed downstream of the valve seat and having an outer periphery defining at least one metering gap, the at least one diaphragm oscillating in the outlet area in response to a pressure of the fuel released into the outlet area and including a first diaphragm and a second diaphragm; and an annular element adjoining the valve seat and being coupled to the valve seat via an inflow channel, wherein an inner portion of the annular element has a recess, the recess having a side wall that tapers upstream counter to a direction of a flow of fuel, and wherein the first diaphragm has a first outer edge portion and the second diaphragm has a second outer edge portion, the first diaphragm extending from a first shoulder portion of the annular element toward the second diaphragm, the second diaphragm extending from a second shoulder portion of the annular element, the area between the first and second outer edge portions defining the at least one metering gap.

15. The electromagnetically actuable fuel injection valve according to claim 10, wherein the at least one metering gap is annular.

16. The electromagnetically actuable fuel injection valve according to claim 14, wherein the first diaphragm extends from the first shoulder portion at an obtuse angle from the horizontal and is bent downward at the first outer edge portion, the second diaphragm having a concave drawn-in area at the second outer edge portion, the second diaphragm determining an ejection angle of the fuel lamella.

17. The electromagnetically actuable fuel injection valve according to claim 14, wherein fuel is ejected from the metering gap at an angle so that the ejected fuel forms an impact area substantially near the side wall of the annular element.

18. A device for modulating an emerging jet fuel from an electromagnetically actuable fuel injection valve for a fuel injection system of an internal combustion engine having a valve housing, a magnetic coil at least partially surrounding the valve housing, and a valve closing element cooperating with the valve housing and being responsive to the magnetic coil, the valve closing element lifting off from a valve seat when the magnetic coil is excited and releasing fuel into an outlet area, the device comprising:

at least one diaphragm disposed downstream of the valve seat and having an outer periphery defining at least one metering gap, the at least one diaphragm oscillating in the outlet area in response to a pressure of the fuel released into the outlet area.

19. A device for modulating an emerging jet fuel from an electromagnetically actuable fuel injection valve for a fuel injection system of an internal combustion engine having a valve housing, a magnetic coil at least partially surrounding the valve housing, and a valve closing element cooperating with the valve housing and being responsive to the magnetic coil, the valve closing element lifting off from a valve seat when the magnetic coil is excited and releasing fuel into an outlet area, the device comprising:

at least one diaphragm disposed downstream of the valve seat and having an outer periphery defining at least one metering gap, the at least one diaphragm oscillating in the outlet area in response to a pressure of the fuel released into the outlet area and including a first diaphragm and a second diaphragm, the at least one metering gap including a first metering gap and a second metering gap; and an annular element adjoining the valve seat and being coupled to the valve seat via an inflow channel, wherein an inner portion of the annular element has a recess, the recess having a side wall that tapers upstream counter to a direction of flow of fuel, the first diaphragm and the recess defining a first oscillation space, the second diaphragm and the recess defining a second oscillation space, the first diaphragm partially covering the first oscillation space and defining the first metering gap, the second diaphragm partially covering the second oscillation space and defining the second metering gap, and wherein an alternating flow of fuel is emitted via the first and second metering gaps when the valve is opened with a high frequency, the high frequency being determined as a function of the first and second diaphragms.

* * * * *

UNITED STATES PATENT AND TRADEMARK OFFICE

CERTIFICATE OF CORRECTION

PATENT No. : 5,685,494

DATED : November 11, 1997

INVENTOR(S): Hans Kubach et al.

It is certified that error appears in the above-identified patent and that said Letters Patent is hereby corrected as shown below:

Column 10, line 51, delete "in" and insert --is--;

Column 11, line 34, after "the" insert --central--;

Column 12, line 13, delete "converting" and insert --covering--;

Column 12, line 14, delete "meeting" and insert --metering--;

Column 12, line 23, delete "our" and insert --out--;

Column 12, line 51, delete "dispose" and insert --disposed--;

Column 13, line 22, delete "10" and insert --14--;

Column 13, line 35, after "jet" insert --of--;

Column 14, line 8, after "jet" insert --of--;

Column 14, line 29, before "flow" insert --a--.

Signed and Sealed this

Twenty-first Day of July, 1998

*Attest:*

*Attesting Officer*

BRUCE LEHMAN

*Commissioner of Patents and Trademarks*